US007771287B2

(12) United States Patent
Staszak

(10) Patent No.: US 7,771,287 B2
(45) Date of Patent: Aug. 10, 2010

(54) CLUB SITTER

(75) Inventor: Ronald James Staszak, Chesterfield, MI (US)

(73) Assignee: Roboys Inc

( * ) Notice: Subject to any disclaimer, the term of this patent is extended or adjusted under 35 U.S.C. 154(b) by 0 days.

(21) Appl. No.: 12/221,761

(22) Filed: Aug. 6, 2008

(65) Prior Publication Data

US 2009/0042662 A1 Feb. 12, 2009

Related U.S. Application Data

(60) Provisional application No. 60/964,375, filed on Aug. 11, 2007.

(51) Int. Cl.
*A63B 55/10* (2006.01)

(52) U.S. Cl. ..... 473/282; 473/409

(58) Field of Classification Search ..... 473/282, 473/409

See application file for complete search history.

(56) References Cited

U.S. PATENT DOCUMENTS 5,765,820 A * 6/1998 Marusiak ..... 269/6

6,283,875 B1 * 9/2001 Jones ..... 473/282

* cited by examiner

*Primary Examiner*—Stephen L. Blau

(57) ABSTRACT

A support and alignment implement for supporting an article such as a golf club in an upright or elevated position comprises of a unibody one piece triangular shaped structure, each end of the "u" shaped portion of the unibody having a round saucer shaped foot to contacts the ground. A pair of arms extend from the center portion that form a tripod and acts as leaf springs to create spring pressure. The legs get crossed over each other to create an opposing force on two heads located at the top of the unibody structure. These two heads are held closed and in contact with one another. One head contains a multi-side locking chamber, which in this design is a square slot that traps the shaft of the club without clamping it. The other head has a flat surface which with the leaf spring pressure of the opposing arms acts like a door that closes the opening of the square slot. In operation the operator squeezes the leaf spring arms towards each other and inserts the golf shaft into the slot, then releases the arms to allow the door to trap the club shaft into the square slot. The round feet are placed on the ground with the golf club in an upright position on the green for support or any where on the course for alignment.

1 Claim, 5 Drawing Sheets

CLUB SITTER

RELATED APPLICATIONS

This application is a continuation-in-part of U.S. Provisional Patent Application.

Application No. 60/964,375
Filed Aug. 11, 2007
Inventor (Applicant) Staszak, Ronald J
Title of Invention—Club Sitter

REFERENCES CITED (REFERENCED BY)

| U.S. Patent Documents | | |
|---|---|---|
| 3,235,997 | February 1966 | Stoner |
| 3,235,998 | February 1966 | Hadley |
| 4,017,997 | April 1977 | Peterson |
| 4,397,112 | August 1983 | York |
| 5,230,507 | July 1993 | White |
| 5,413,329 | May 1995 | Hirsch |
| 5,482,247 | January 1996 | Smith |
| 5,492,230 | February 1996 | Horton |
| 5,765,820 | June 1998 | Marusiak |
| 5,782,704 | July 1998 | Tetler |
| 5,853,336 | December 1998 | Hufgard |

FIELD OF INVENTION

The present invention generally relates to a field of support and alignment implements. It particularly relates to a device for supporting an article having a round shaft, oval shaft, square shaft, triangular shaft, hexagonal shaft, and octagonal shaft or virtually any shaped shaft. It accomplishes this without actually clamping the shaft with spring pressure such as a golf club or similar article. More specifically, in a preferred embodiment, the device of the present invention relates to a golfing accessory for supporting a golf club in an upright position. The device also can be used for providing a visual alignment of the golf club relative to the intended line of play.

BACKGROUND OF THE INVENTION

The game of golf, the training, and general accessories have grown in the sport not only in the United States but throughout the world. There are many types of devices developed to enhance the playing of golf are devices which support a golf club in an upright position, rather than laying the club on the fairways and putting greens, such that the handle of the golf club does not contact the ground. These support devices not only prevent the golf handle from getting wet or muddy as the result of morning due or earlier rains, but also allow golfer to grab his club without having to bend. In addition, the use of such support devices prevent contamination of the golf club grips from chemicals, pesticides and fertilizers which commonly are used in the maintenance of golf courses, thereby preventing such chemicals from being transferred to the hands and body of the golfer.

The prior art is replete with numerous devices designed to support a golf club in an upright position. For example, U.S. Pat. No. 5,230,507 to White et al. provides a portable golf club supporting aid having a notched opening for receiving a shaft of a club. In operation, the golfer inserts the club shaft within the notched opening and must slide the device off of the supporting aid when he wishes to use the club. A more complicated device is shown in U.S. Pat. No. 5,492,230 to Horton which discloses a collapsible golf club stand having a pair of legs attached to a golf club shaft engaging member. To engage or disengage the golf club from the golf stand, the user must hold the stand in one hand in its closed position, gripping the upper portion of the legs and grip portion, and snap the lower end of the golf club shaft into or out of a recessed area. U.S. Pat. No. 5,076,581 to Boberg discloses a one-piece apertured prop for spacing the handgrip of a golf club from the ground. Although each of the above-described devices may accomplish the intended objective of maintaining a golf club in a position such that the handle does not contact the ground, it appears that none of these support devices has found commercial success.

In addition, several devices have been developed to assist the golfer in selecting an appropriate alignment of the golf club (or putter) with the intended line of play. These devices provide both support and alignment of a golf club. For example, U.S. Pat. No. 5,482,247 to Smith provides a golf club stand device having a connector portion which holds a portion of a golf club shaft, particularly a putter, and a leg structure portion which can support the putter in an upright position on a putting green such that the golfer can align his putts. The leg structure includes means to release the support legs from the extended position to a retracted position such that the golfer can putt with the device still connected to the putter shaft. U.S. Pat. No. 5,413,329 to Hirsch describes a golf club alignment guide for support a golf club in the form of a triangular bracket having C-shaped spring clamp for holding the shaft of a putter.

Despite the developments of the prior art, there is still a need for a more special support and alignment implement. This specialized device should be capable of supporting a golf club, putter or any conventional type club having an round shaft, oval shaft, square shaft, triangular shaft, Octagonal shaft, or hexagonal shaft. Included should be any shaft design possible. Such a device should not clamp the shaft with spring pressure or rely on a particular shape or geometry of the shaft holding area such as "C" shaped "O" shaped. Instead it should allow the shaft to spin freely once trapped and lock the shaft in place using the shafts own gravitational weight. This way the geometry or the shaft itself ceases to be a factor allowing the device should spin freely also eliminate having to attach and reattach the device to find a particular balance point. It should be easy to use and of a one piece structure without the need for multiple components which increases manufacturing assembly cost and makes it unaffordable for many people.

SUMMARY OF INVENTION

Accordingly, it is an object of the present invention to provide a support implement for supporting and maintaining an article having a round shaft, oval shaft, square shaft, triangular shaft, octagonal shaft, or hexagonal shaft.

It is another object of the present invention to provide a support and alignment implement for supporting and maintaining a golf club in an upright position, without the need for clamping with spring pressure utilizing a special "multi sided locking chamber."

It is an additional object of the present invention to provide a support and alignment implement which can quickly but securely engage or disengage a portion of a round shaft, oval shaft, square shaft, triangular shaft, octagonal shaft or hexagonal shaft without spring pressure. This is accomplished with a "multi sided locking chamber" so the geometry of the shaft does not dictate the contact geometry of the shaft holding area of the implement.

It is still another object of the present invention to provide a support and alignment implement which is capable of immediate use and will allow the ability for the device itself to spin freely around the shaft of the club. This automatically results in not having to attach and reattach the device to find a particular balance point.

It is yet another object of the present invention to provide a support and alignment implement which is relatively lightweight and compact such that it can be stored in the user's pocket or the pocket of a golf club bag or tackle box.

It is further object of the present invention to provide a support and alignment implement which is of simple single piece construction and inexpensive to manufacture The device has no need for multiple components such as screws, bolts, springs, pins, clips, stand components, or separate individual legs which cost assemble time. Additional objects, advantages and novel features of the invention will be set forth in part of the description which follows, and in part will become apparent to those skilled in the art upon examination of the following specification or may be learned by practice of the invention.

BRIEF DESCRIPTION OF THE DRAWINGS

The present invention will be better understood with reference to the appended drawing sheets, wherein.

DETAILED DESCRIPTION

The present invention relates to an implement for supporting and aligning a golf club. This club includes a putter or any other club in the bag. Included are other articles having a round shaft, oval shaft, square shaft, triangular shaft, hexagonal shaft or octagonal shaft in an upright position. More particularly, the present invention provides a golfing accessory for supporting a golf club in an upright position and for aligning the club relative to the intended line of play.

Figure 1:
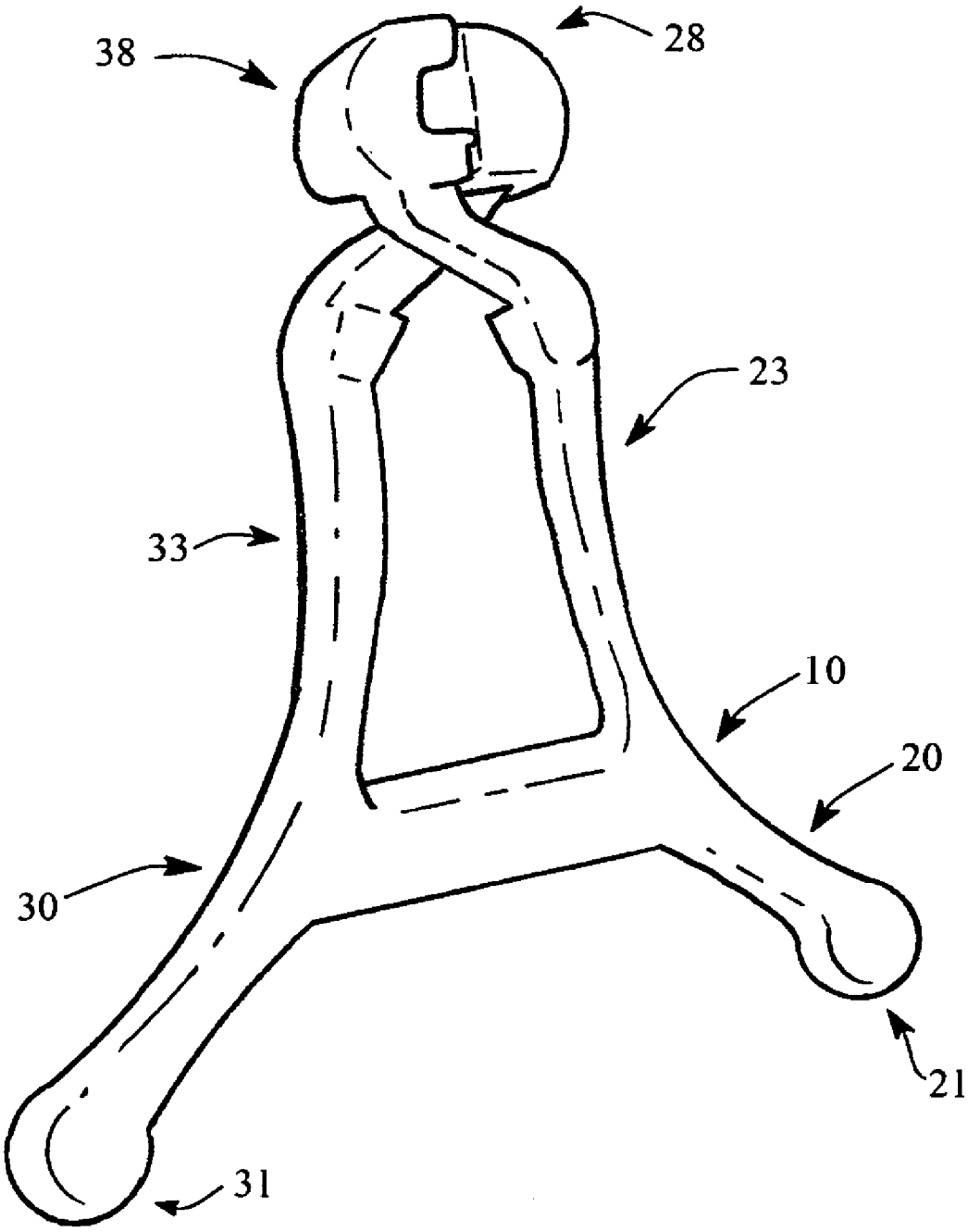
FIG. 1 illustrates a side perspective view of the golf support and alignment implement of the present invention shown closed.
Figure 2:
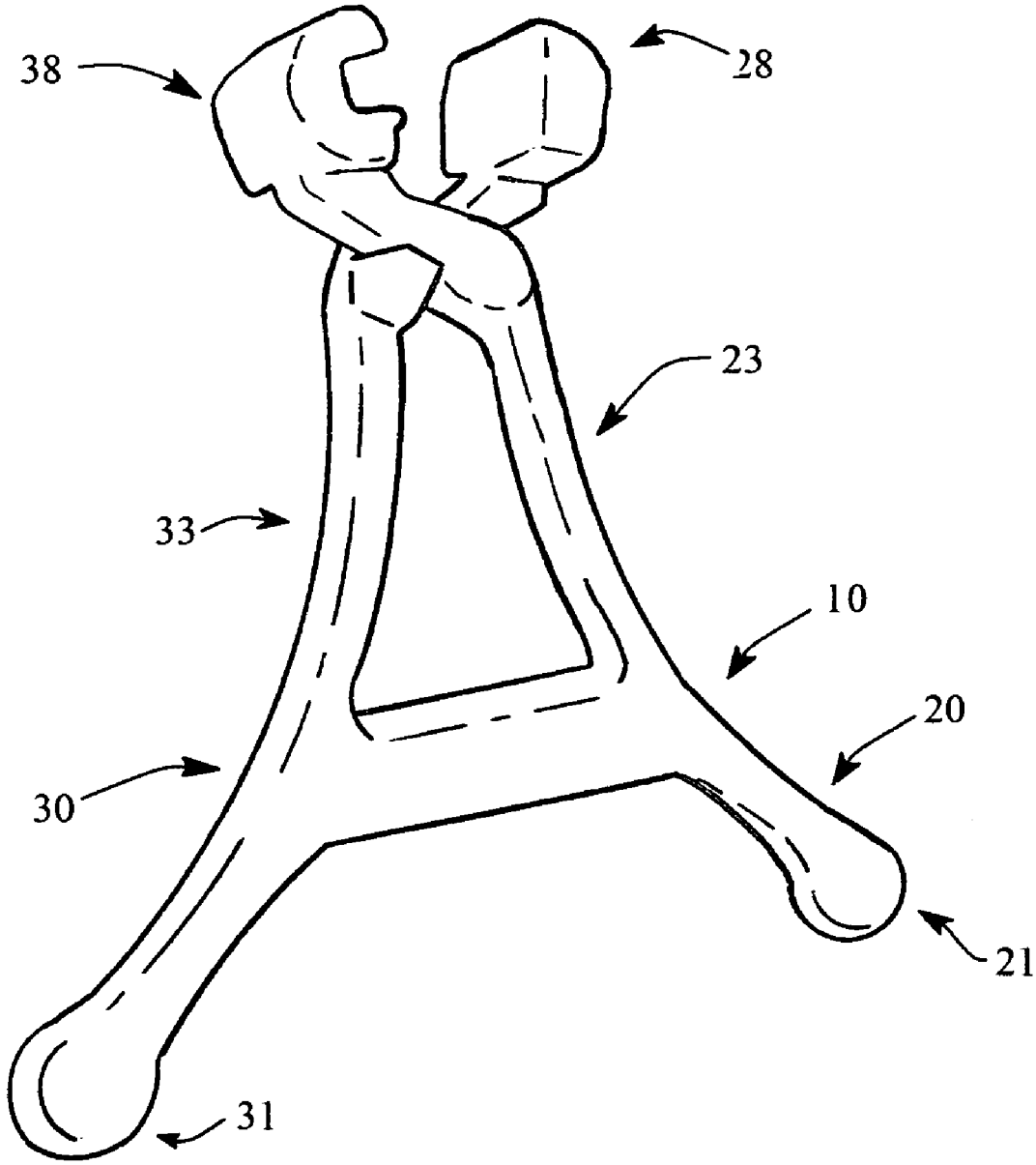
FIG. 2 illustrates a side/bottom perspective view of the support and alignment implement of the present invention shown open.

Referring to FIG. 1 with the implement shown closed and FIG. 2 shown open, the support and alignment implement 10 comprises a one piece unibody construction. Extending from the center of the unibody on the lower side are two non-moving legs 20 and 30. Out at the end of each leg are round saucer shaped feet 21 and 31 for ground engagement to form a tripod when attached to a golf club.

The complete implement is a one piece unibody structure and may be construction or manufactured from a solid. Suitable materials include, for example, wood, metal, fiberglass, plastic, graphite and rigid plastic materials. Preferably it is constructed of a special plastic which is called ultra exotic permanent memory spring plastic.

Figure 3:
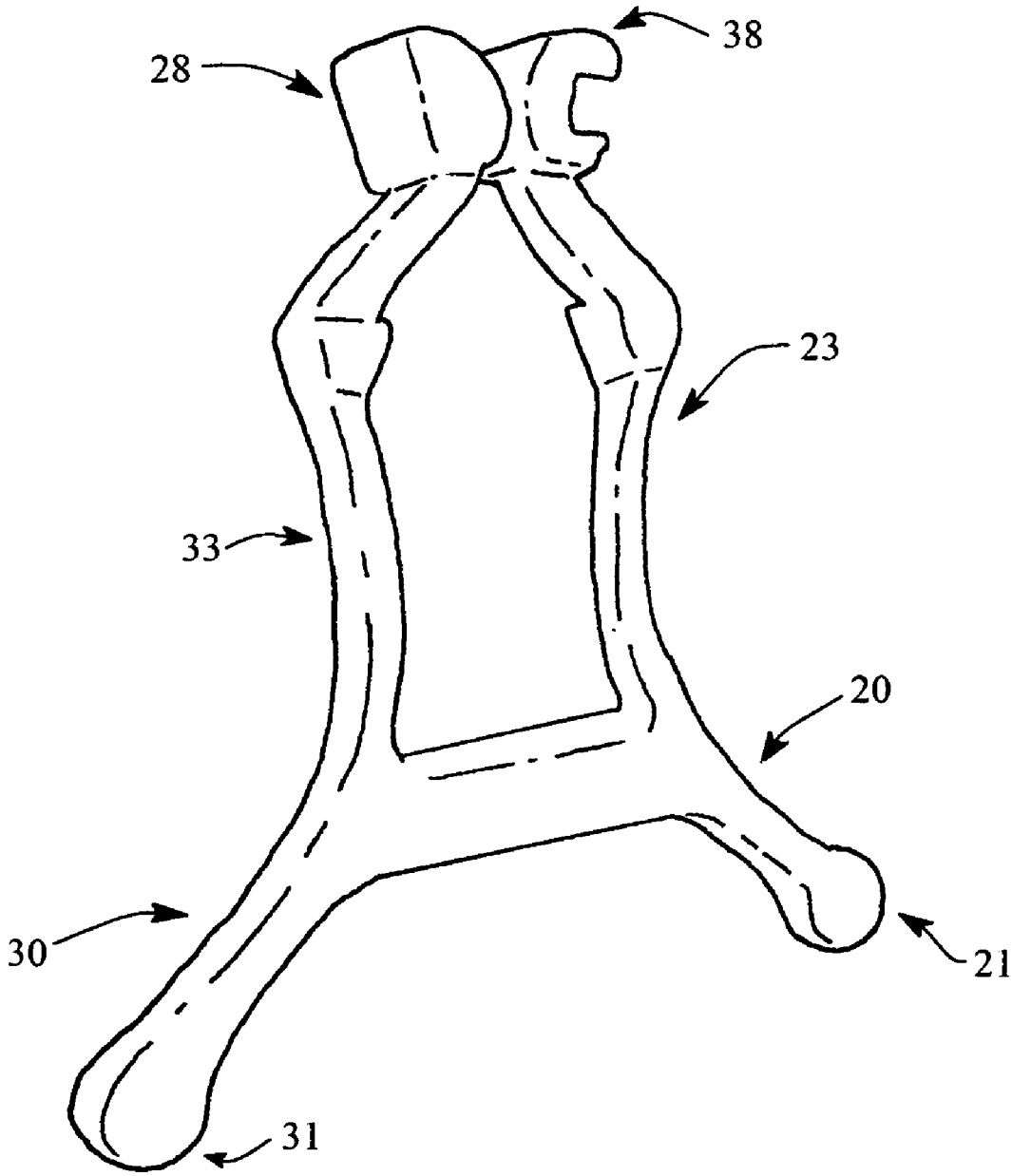
FIG. 3 illustrates a side perspective view of the implement embodiment of the support implement as it is first taken out of the mold "uncrossed."

As shown in FIG. 3, the device can also be manufactured from a less expensive plastic. This is possible because if stored "uncrossed" or "un-flipped" as shown in FIG. 3 the device literally restores its own memory. In this position it causes the arms to push against each other with opposite force then when the implement is in use.

Extending from the center of the unibody on the upper side are two flexible arms 23 and 33 which act as leaf springs. These arms once taken out of the mold are as shown in FIG. 3 "uncrossed" and after the plastic cools are "crossed" or "flipped" over each other to reverse the spring pressure of the arms towards the center of the unibody as shown in FIG. 1 and FIG. 2.

Figure 4:
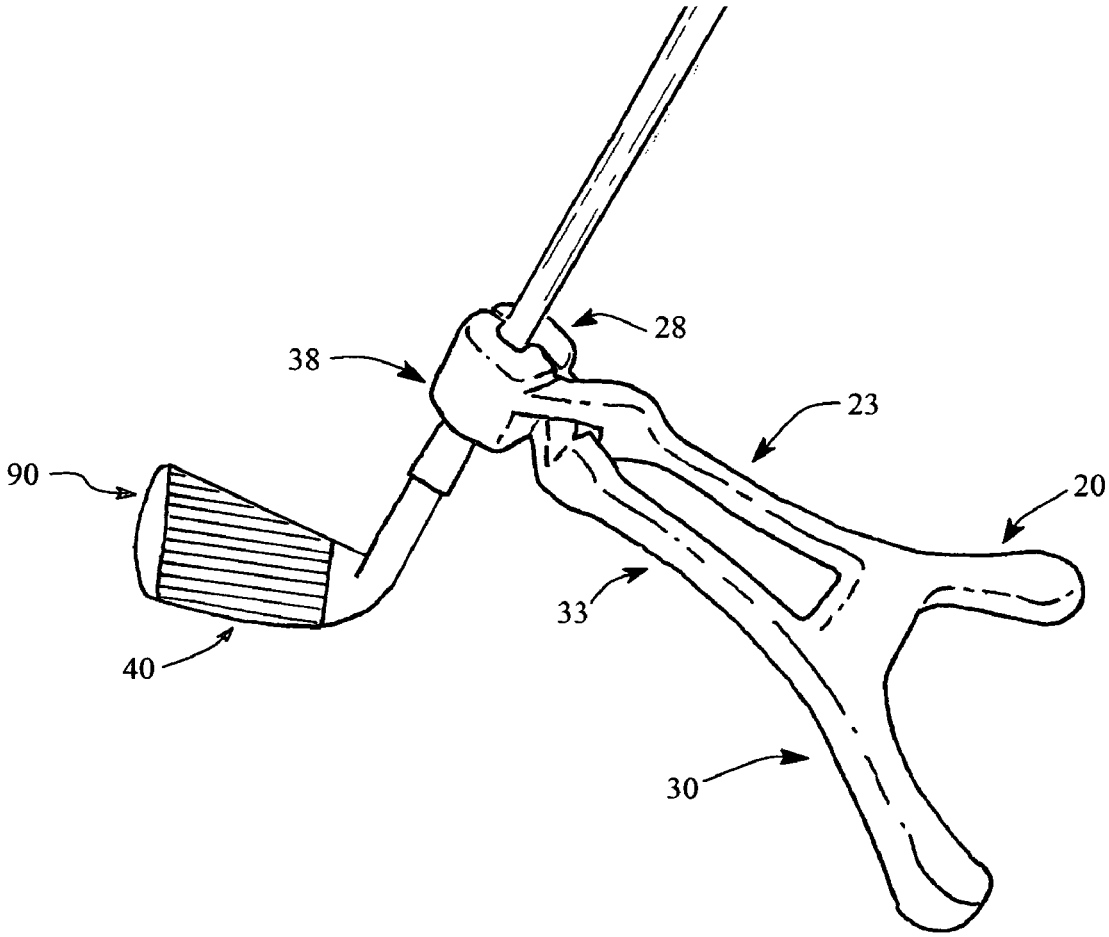
FIG. 4 illustrates a side perspective view of the support and alignment implement of the present invention attached to a golf club shaft.
Figure 5:
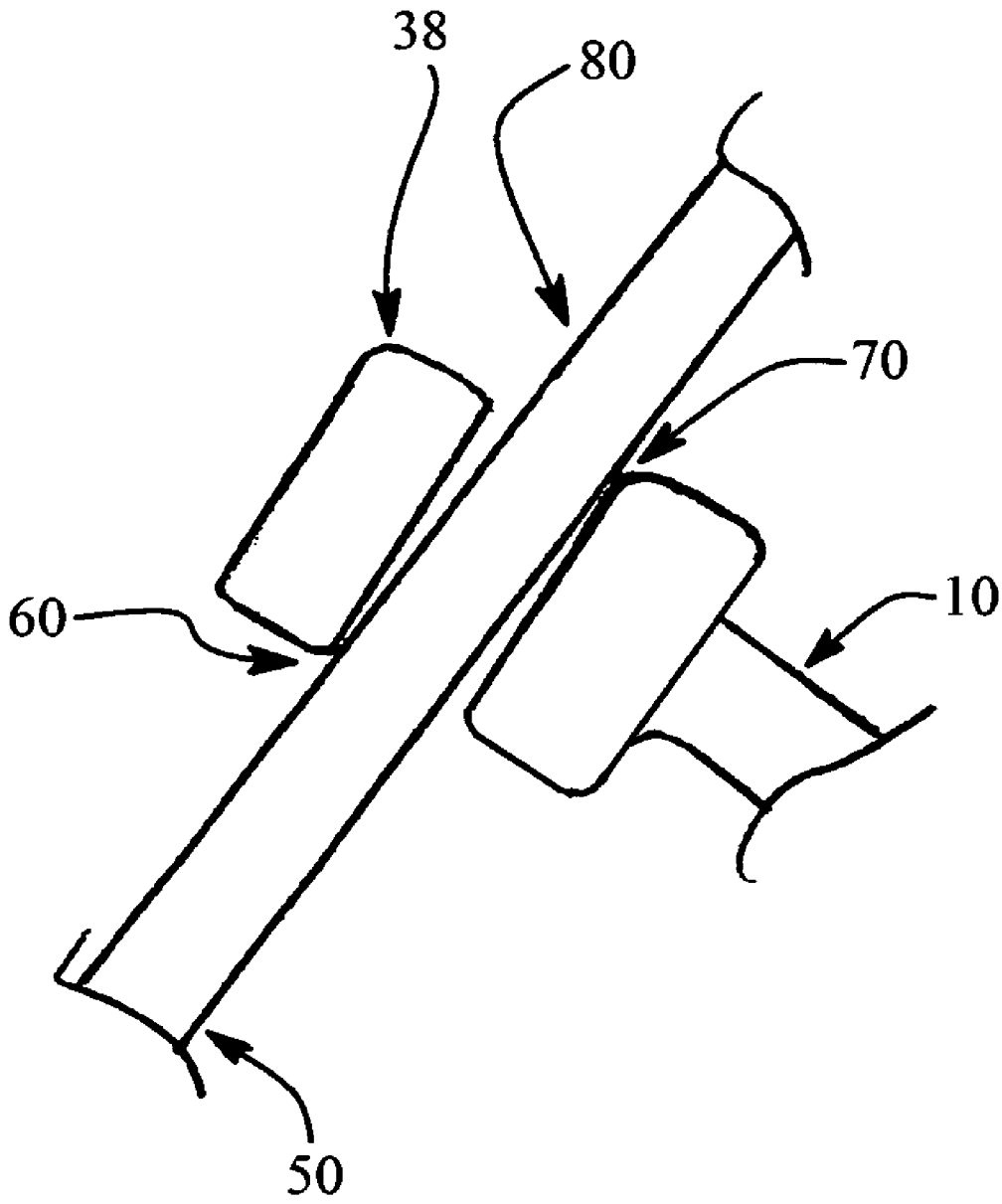
FIG. 5 illustrates a sectional view of the "multi-sided locking chamber."

Located on the top of each arm is the club holding heads. The one head 38 is called the "multisided locking chamber" the multisided locking chamber is shown on all drawings in FIGS. 1, 2, 3, 4, and 5. A "multisided locking chamber" 38 (this claim patents the action) located at the end of one of the arms 23 looks like a three sided square slot. It however can have any type of shape of walls in design just so the contact point 60 and 70 are made as shown in FIG. 5. The function is where as the locking chamber holds the club shaft in place utilizing the top and bottom contact of the golf club shaft. It works on a combination of the leaning effect of the club head and shaft below the club holding product 50. The greater force is generated by the gravitational downward pull of the shaft above the club holding implement 80 as it extends on and angle in open space. The result is a locking force that holds the club without the need for spring clamping pressure imposed on the shaft itself by the club holding implement. The multisided locking chamber is capable of holding virtually any club shaft, round, oval, square, triangular, hexagonal, or octagonal. This can be accomplished because it never clamps the shaft with spring pressure and has no special shaft contact area such as "C" shaped or "O" shaped that have to conform to the geometry of a particular club shaft shape. This is unlike all other related products allowing the implement to spin around the shaft. Simply by pointing the toe of the club head 90 degrees as shown in FIG. 4 to the sky. The device spins by gravity effect and perfectly balances itself to set on the ground to stand the club up. There is no need for guessing or attaching and re-attaching to find a balancing point.

A door 28 located at the end of one of the arms 33 operates through the reverse action of the leaf spring arm. The door closes in operation trapping the club In the "multisided locking chamber". This is accomplished without applying direct spring pressure to the club shaft itself as shown in FIG. 5

FIG. 3 the device is ejected from the mold in an uncrossed position in one piece the arms 23 and 33 are reduced in thickness in the area they will be crossed to allow them to center there selves as shown in FIG. 1 and FIG. 2.

Although the golf club support and alignment implement of the present invention can be used to support a single golf club. It can also support several clubs at the same time. For example, a golfer can use the device of the present invention to support both a pitching iron and putter on the rough surrounding the green.

While particular embodiments of the invention have been described, it will be understood, of course, that the invention is not limited thereto, and that many obvious modification and variations can be made, and that such modifications and variation are intended to fall within the scope of this disclosure and the appended claims.

What is claimed is:

1. A method which provides a golf player with both a means to support a golf club and a means to determined actual direct alignment of the face of the golf club with the intended line of play, the golf club having a round, oval, square, triangular, hexagonal, or octagonal shaft, a gripping end, a club head end, said method comprising:

(1) installing a golf club support and alignment implement onto said shaft of said golf club near said club head end, said club support and alignment implement comprising:

(a) only a one piece unibody integrally formed having two movable arms, said club support and alignment implement free from screws, bolts, pivot pins, clips, and separate springs, said club support and alignment implement free from separately formed legs, separately formed rods or separate formed pivot links;

(b) each arm of said two movable arms acts as a leaf spring and is able to cross over the other arm creating a spring force able to retain said golf club shaft in said club support and alignment implement;

(c) a locking chamber located at an end of one of said arms able to either clamp of trap said shaft inside said chamber;

(d) a door located at an end of one of said arms which does not have said locking chamber able to close on said chamber by spring force, wherein said club support and alignment implement when installed is either able to clamp to said club or spin around said club; and (e) a pair of saucer shaped round feet that are part of a "U" shaped portion of said unibody.

* * * * *